United States Patent [19]

Horton et al.

[11] 3,951,775

[45] Apr. 20, 1976

[54] ELECTROCOATING TANK ARRANGEMENT

[75] Inventors: David M. Horton; William S. Mitchell, both of Evansville, Ind.

[73] Assignee: George Koch Sons, Inc., Evansville, Ind.

[22] Filed: Aug. 15, 1975

[21] Appl. No.: 605,212

Related U.S. Application Data

[63] Continuation of Ser. No. 323,841, Jan. 15, 1973, abandoned.

[52] U.S. Cl. ..... 204/299 EC; 204/181; 204/300 EC

[51] Int. Cl.[2] ..... C25D 1/12; C25D 1/18

[58] Field of Search ..... 204/181, 299, 300

[56] References Cited

UNITED STATES PATENTS

| | | | |
|---|---|---|---|
| 3,444,066 | 5/1969 | Brewer et al. | 204/181 |
| 3,496,082 | 2/1970 | Orem et al. | 204/300 X |
| 3,556,970 | 1/1971 | Wallace et al. | 204/181 |
| 3,592,755 | 7/1971 | Thornton | 204/299 |
| 3,616,396 | 10/1971 | Swanson | 204/181 |

*Primary Examiner*—John H. Mack
*Assistant Examiner*—A. C. Prescott
*Attorney, Agent, or Firm*—Jenkins, Hanley & Coffey

[57] ABSTRACT

An electrocoating tank arrangement characterized by a centrally and longitudinally disposed paint supply header extending along and proximate to the bottom of the tank, where the tank has sloped bottom walls, and where a highly desirable paint agitation pattern is achieved, permitting the part or article under processing to be effectively coated with optimum results. The electrocoating tank may further include adjustable weir arrangements at opposite ends thereof to promote surface circulation. The paint material is recirculated through conventional means and the electrocoating tank forms an important function in a conveyorized operation.

6 Claims, 3 Drawing Figures

ELECTROCOATING TANK ARRANGEMENT

This is a continuation of application Ser. No. 323,841 filed Jan. 15, 1973, now abandoned.

As is known, the use of an electrocoating tank for coating parts is widespread, where, typically, such tank is associated with a conveyorized operation. In this connection, an overhead conveyor may be employed, where the part carried thereby is immersed in the desired solution in the tank, and, after coating, withdrawn from the tank. A serious objection to the preceding arrangements has been the settling or accumulation of the coating materials, thereby resulting in a non-uniformly coated part. Obviously, therefore, the desire for optimum finished for the customer are one of the chief concerns of the equipment manufacturer.

Briefly, the invention provides a new approach to a conveyorized or batch type electrocoating tank arrangement, whereby the supply header is disposed centrally and longitudinally along the bottom of the tank, and where such tank has sloped bottom wall portions blending into the side walls of the tank. A single supply header may be used or such may be in the form of a plurality of individual sections, as described herein, conventionally fed from a main header responsive to a recirculating pump. In other words, from the aforesaid configuration, the invention provides a flow pattern whereby the coating material is deflected upwardly and then passes downwardly for the desired mixing thereof for the coating of the part under process.

Additionally, a troughdefining an adjustable weir is disposed at opposite ends of the electrocoating tank for creating a surface movement of the coating material away from such ends, thereby effectively eliminating debris and permitting the "clean" entry and exit of the processed part. In other words, a gentle surface movement is the result for ease in submerging and emerging the part in the coating material.

Figure 1:
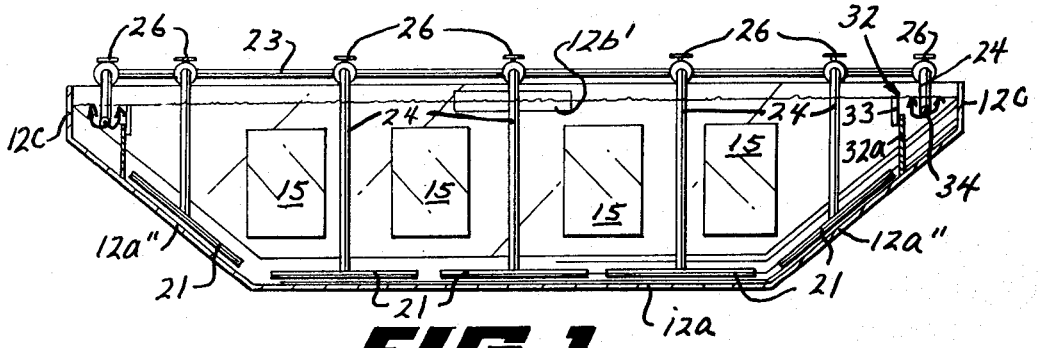
Figure 3:
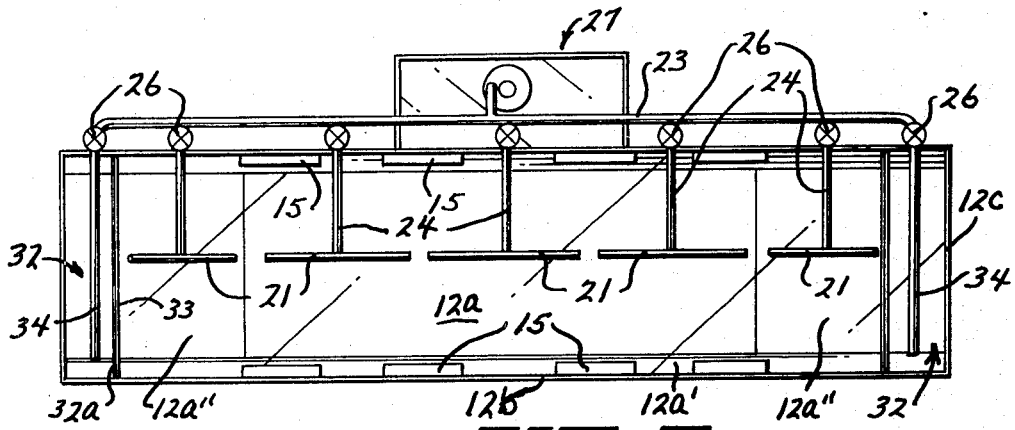
Figure 2:
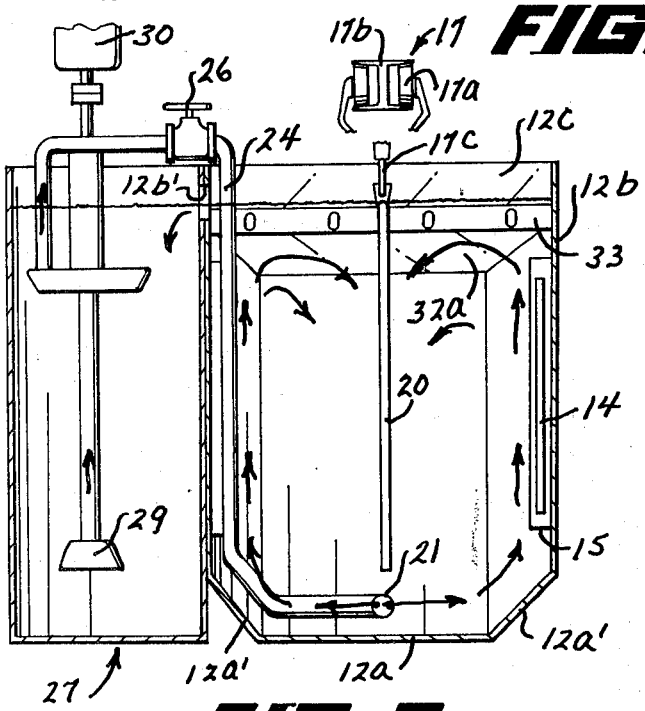

A better understanding of the present invention will become more apparent from the following description, taken in conjunction with the accompaying drawing, wherein FIG. 1 is a view in side elevation, partly in vertical section, showing an electrocoating tank arrangement in accordance with the present invention;

FIG. 2 is a transverse view in vertical section, partly fragmentary, and with certain structure removed for clarity of presentation, showing in more detail the flow pattern achieved by the invention; and, FIG. 3 is a top plan view showing still further details of the invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principls of the invention as illustrated therein being contemplated as would normally occur to one skilled in the art to which the invention relates.

Referring now to the figures, the electrocoating tank 12 of the invention comprises a bottom wall **12*a* having upturned or sloped side portions 12*a'* and the usual inclined end portions 12*a''*, all blending into side walls 12*b* and end walls 12*c*. In a preferred embodiment of the invention, the sloped side portions 12*a'* of the bottom wall 12a** of the electrocoating tank assume a 45° angle.

As particularly evident in FIGS. 1 and 3, cathodes 14 are spaced along the side walls **12*b*, being mounted in position by conventional means (not shown). Typically, an expanded metal screen 15 cover each cathode 14** for purposes of protection.

The overall installation further includes a conventional overhead conveyor 17 defined by wheels **17*a* supported by an I-beam 17*b* and a hanger assembly 17*c* (not shown in detail), including a drive chain, supporting a part 20 under process. As conventional, the I-beam 17*b* angles downwardly to permit the submerging of the part 20** below the coating liquid level and, thereafter, after coating, is inclined upwardly for part emerging purposes. In a typical installation, the electrocoating tank may have a length in the order of 40 feet.

As to the invention, a supply header 21, either unitary or in sections, is disposed centrally and longitudinally along the bottom wall **12*a*, or proximate to the bottom wall 12*a*, the electrocoating tank 12, which supply header 21 has a series of oppositely disposed orifices for feeding the coating material in a generally horizontal direction. As should be apparent from FIG. 2, and importantly, the arrows therein show the flow pattern cycle resulting from the sloped side portions 12*a'* of the bottom wall 12*a***, i.e. the coating material is deflected upwardly and, thereafter, toward the center of the tank at the surface and onto the part, resulting in gentle and mild coating action.

More specifically, in order to effectively achieve the desired results, the orifices in the supply header 21 are sized or so dimensioned as to eliminate any settling of the immersible and colloidal solutions onto the bottom wall **12*a* of the electrocoating tank 12. By the preceding, agitating and lifting action is created so that any solids in the lower solution level move toward the surface of the tank 12, subsequently settling toward the bottom of the tank 12** to again become part of the cycular pattern. In other words, any violent or turbulent flow along the tank perimeter maintains the coating material free from settling or accumulation, thereby providing stability during the coating operation.

As a matter of illustration, each section of supply header 21 interconnects a main header 23 by means of a pipe 24, the latter extending upwardly adjacent a side wall **12*b* and between the cathodes 14, where, typically, a valve 26 may be employed. As should be evident in FIG. 1, a center weir 12*b'* is provided in a side wall 12*b* of the electrocoating tank 12, communicating with a control tank 27 having a pump 29 driven by a motor 30. In other words, coating material flows into the control tank 27 and, thereafter, is pumped into the main header 23** for distribution and recirculation.

Another feature of the invention, particularly evident in FIGS. 1 and 3, are troughs 32 disposed at opposite ends of the electrocoating tank 12 for purposes of surface agitation. In this connection, each trough 32 is defined by fixed upstanding inner wall 32a having a fixed upstanding inner wall 32a having a vertically adjustable strip 33 at the upper portion thereof, serving as a weir for liquid level control. Each trough 32 further includes a transverse header 34 connecting to the main header 23 and having a downwardly oriented orifice for passing the coating. In other words, the coating material is deflected upwardly on either side of the transverse header 34 to create surface movement from the ends of the tank 12 toward the mid-portion thereof and to free the surface from any debris. Thus, optimum coating is provided for the submerging and emerging part 20.

In other words, the invention provides importance in defining a flow material cycling pattern, where, in the first instance, sediment or the like is prevented from settling onto the bottom of the tank 12, and, at the same time, surface agitation is achieved, as for eliminating debris. The invention is susceptible to various changes, including, by way of example, reproportioning, the use of additional electrodes, changes in the end weir arrangements, the deflection angle of the sloped bottom wall portions, and central weir 12*b'* may be at the end of the tank 12. Thus, the above description should be considered illustrative and not as limiting the scope of the following claims:

We claim:

1. An electrocoating tank arrangement comprising a tank for containing coating material and having side walls, end walls, and a bottom wall with upwardly and outwardly sloped wall portions blending into said side walls, one of said side walls having a central overflow opening formed therein; a supply header having a supply portion longitudinally and centrally disposed within said tank at aid bottom wall, said supply portion having formed therein generally opposed orifices at the sides thereof; pump means for supplying coating material to said supply header to cause coating material to said supply header to cause coating material circulation upwardly along said sloped wall portions and side walls, and then downwardly at the longitudinal upper center of said tank; a weir arrangement at each end of said tank having a trough with a horizontally extending strip separating said trough from coating material in said tank; and means for supplying coating material to each of said troughs to cause coating material to spill over each of said horzontal strips and flow therefrom toward the center of said tank and outwardly through said overflow opening.

2. An electrocoating tank arrangement as set forth in claim 1 wherein each of said horizontally extending strips is vertically adjustable.

3. An electrocoating tank arrangement as set forth in claim 1 with the addition of a control tank for receiving coating material flowing outwardly through said overflow opening, said control tank being in flow communication with said pump means for supplying coating material thereto.

4. An electrocoating tank arrangement comprising a tank for containing coating material and having side walls, end walls, and a bottom wall, one of said side walls providing a central overflow opening; a trough at each end of said tank having a horizontally extending weir separating said trough from the coating material in said tank; and means for supplying coating material to each of said troughs to cause coating material to spill over said horizontal weirs to create coating materials surface flow from each of said troughs toward the center of said tank and outwardly through said overflow opening.

5. An electrocoating tank arrangement as set forth in claim 4 wherein each of said horizontally extending strips is vertically adjustable.

6. An electrocoating tank arrangement as set forth in claim 4 with the addition of a control tank for receiving coating material flowing outwardly through said overflow opening, said control tank being in flow communication with said pump means for supplying coating material thereto.

* * * * *

UNITED STATES PATENT OFFICE

CERTIFICATE OF CORRECTION

Patent No. 3,951,775 Dated April 20, 1976

Inventor(s) David M. Horton and William S. Mitchell

It is certified that error appears in the above-identified patent and that said Letters Patent are hereby corrected as shown below:

Column 1, line 15, after "finished" insert --results--.

Column 1, line 31, leave a space between "trough" and "defining".

Column 2, line 59, after "by" insert --a--.

Column 2, line 60, delete "fixed upstanding inner wall 32a having a".

Column 3, line 25, change "aid" to --said--.

Column 3, line 28, delete "to said".

Column 3, line 29, delete "supply header to cause coating material".

Column 4, line 22, change "materials" to --material--.

Signed and Sealed this

*twenty-second* Day of *June 1976*

[SEAL]

*Attest:*

RUTH C. MASON
*Attesting Officer*

C. MARSHALL DANN
*Commissioner of Patents and Trademarks*